US005662136A

United States Patent [19]

Drzewiecki et al.

[11] Patent Number: 5,662,136

[45] Date of Patent: Sep. 2, 1997

[54] ACOUSTO-FLUIDIC DRIVER FOR ACTIVE CONTROL OF TURBOFAN ENGINE NOISE

[75] Inventors: Tadeusz M. Drzewiecki, Rockville; John B. Niemczuk, Kensington, both of Md.; Christopher R. Fuller, Norfolk, Va.; Russell H. Thomas, Hampton, Va.; Ricardo A. Burdisso, Blacksburg, Va.

[73] Assignees: Defense Research Technologies, Inc., Rockville, Md.; Virginia Tech Intellectual Properties, Inc., Blacksburg, Va.

[21] Appl. No.: 498,489

[22] Filed: Sep. 11, 1995

[51] Int. Cl.[6] ..... F15C 1/04; F15C 1/12

[52] U.S. Cl. ..... 137/14; 137/828

[58] Field of Search ..... 137/828, 14, 803; 181/206

[56] References Cited

U.S. PATENT DOCUMENTS

| | | | |
|---|---|---|---|
| 2,043,416 | 6/1936 | Lueg . | |
| 3,239,027 | 3/1966 | Schuck | 181/120 |
| 3,398,758 | 8/1968 | Unfried | 137/828 |
| 3,425,430 | 2/1969 | Horton . | |
| 3,500,952 | 3/1970 | Beeken . | |
| 3,529,615 | 9/1970 | Kishel . | |
| 3,561,463 | 2/1971 | Beeken . | |
| 3,666,273 | 5/1972 | Kantola et al. . | |
| 3,683,951 | 8/1972 | Beaumont . | |
| 3,826,870 | 7/1974 | Wurm et al. | 181/206 |
| 3,936,606 | 2/1976 | Wanke | 181/206 |
| 3,999,625 | 12/1976 | Pickett et al. | 137/828 |
| 4,025,724 | 5/1977 | Davidson, Jr. et al. | 181/206 |
| 4,121,620 | 10/1978 | Pickett et al. | 137/828 |
| 4,258,754 | 3/1981 | Pickett | 137/819 |
| 4,373,553 | 2/1983 | Drzewiecki | 137/840 |
| 4,512,371 | 4/1985 | Drzewiecki et al. | 137/828 |
| 4,689,827 | 8/1987 | Gurney, Jr. | 137/828 |
| 5,040,560 | 8/1991 | Glezer et al. | 137/828 |
| 5,097,923 | 3/1992 | Ziegler et al. | 181/206 |
| 5,377,275 | 12/1994 | Suzuki | 181/206 |
| 5,498,127 | 3/1996 | Kraft et al. | 181/206 |

FOREIGN PATENT DOCUMENTS

| | | | |
|---|---|---|---|
| 2507428 | 8/1975 | Germany | 181/206 |
| 6102886 | 4/1994 | Japan | 181/206 |

OTHER PUBLICATIONS

Fluidics Quarterly Tenth Anniversery Fluidics Symposium Atlanta/Jun. 1970.

Drzewiecki article "A Fluidic Audio Intercom", ASME 1980, pp. 89–94.

Drzewiecki Ph.D. Thesis "A Fluidic Voice Communication System and Data Link", Mar. 1980, pp. 17–187.

Srour et al, "An Individual Soldier–Operated Personal Acoustic–Detection System (ISOPADS)", May 1990, pp. 4–20.

Thomas et al, "Active Control of Fan Noise from a Turbofan Engine", Jan. 1993, pp. 1–9.

*Primary Examiner*—A. Michael Chambers

[57] ABSTRACT

Reduction or cancellation of acoustic noise is achieved by providing an amplified, oppositely phased version of the noise by means of an acousto-fluidic amplifier. The amplified acoustic output noise is delivered through an impedance matching horn in destructively interfering relation with the original noise. Depending on the acoustic noise source and its spatial distribution, the acousto-fluidic amplifier may be a single stage amplifier or multiple stages connected in parallel and/or cascade, with output horns spatially distributed to have the maximum cancellation effect. Sensed noise, prior to fluidic amplification, may be processed in a manner to effect feedback or feedforward control of the amplified acoustic output signals.

26 Claims, 10 Drawing Sheets

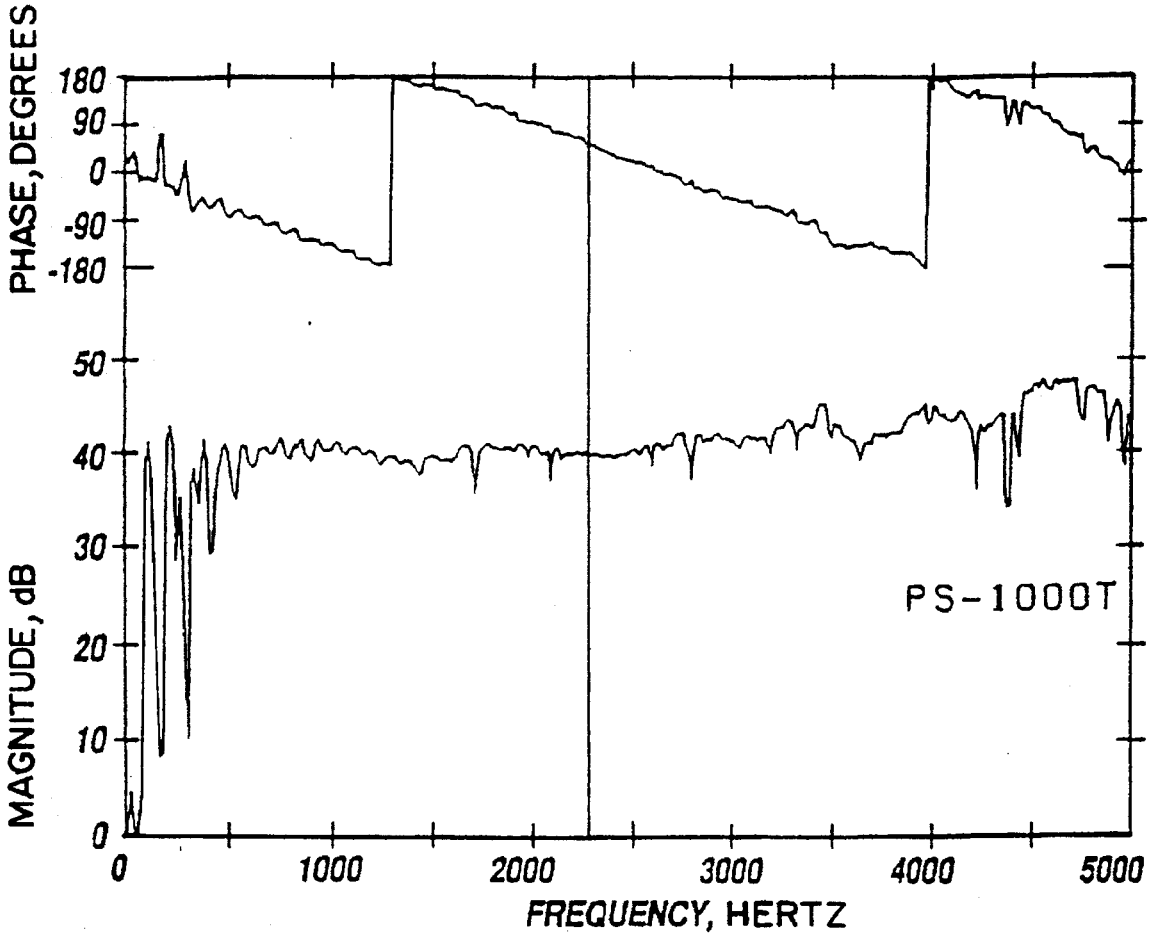
FIG.2 (FREQUENCY RESPONSE OF A [2]51005(2)+[4]51005(2)+[8]51005(2) [16]51005(2) AMPLIFIER.)

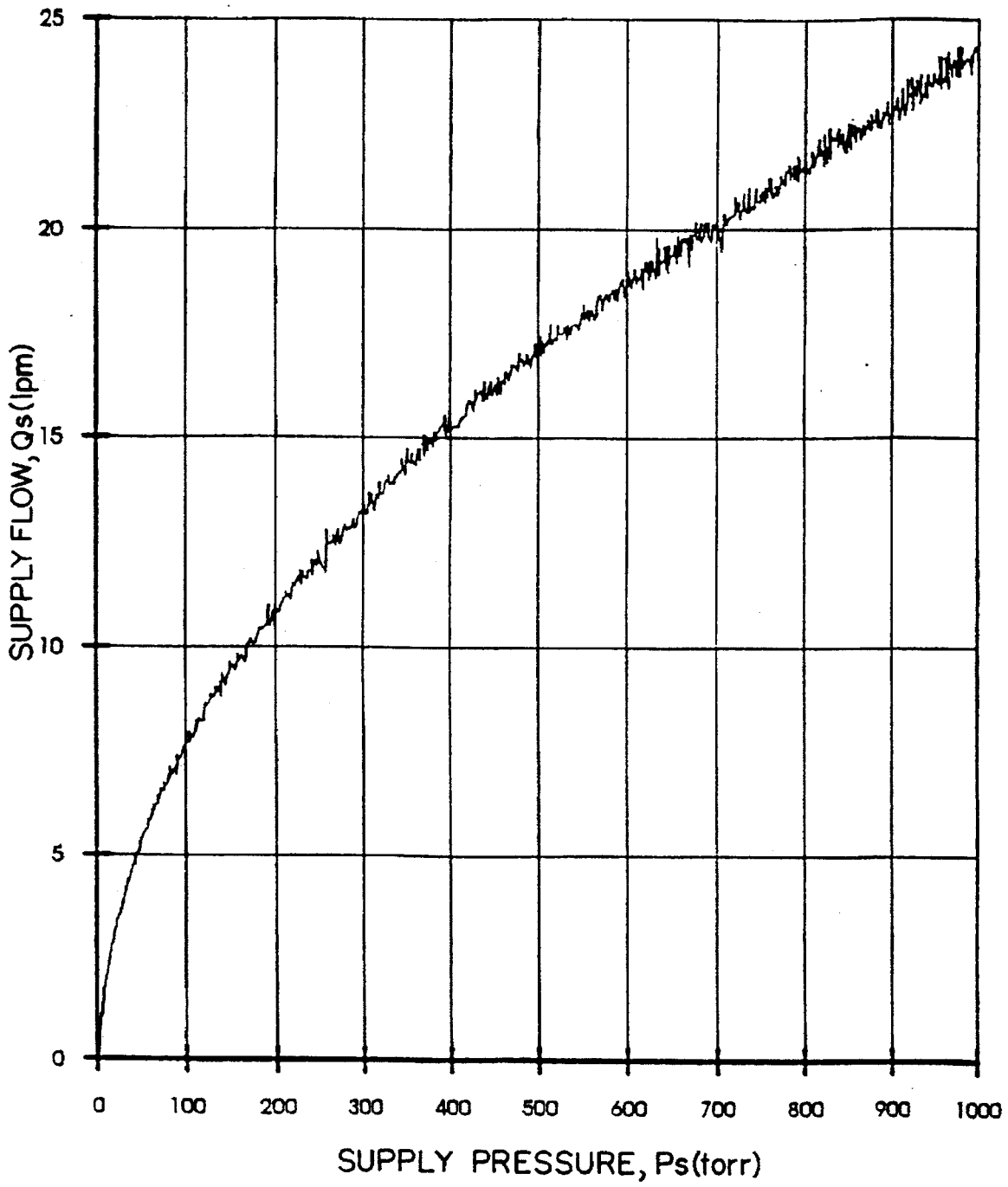
FIG. 3 (FLOW CONSUMPTION OF THE LAST STAGE OF AN ACOUSTO-FLUIDIC DRIVER MODULE.)

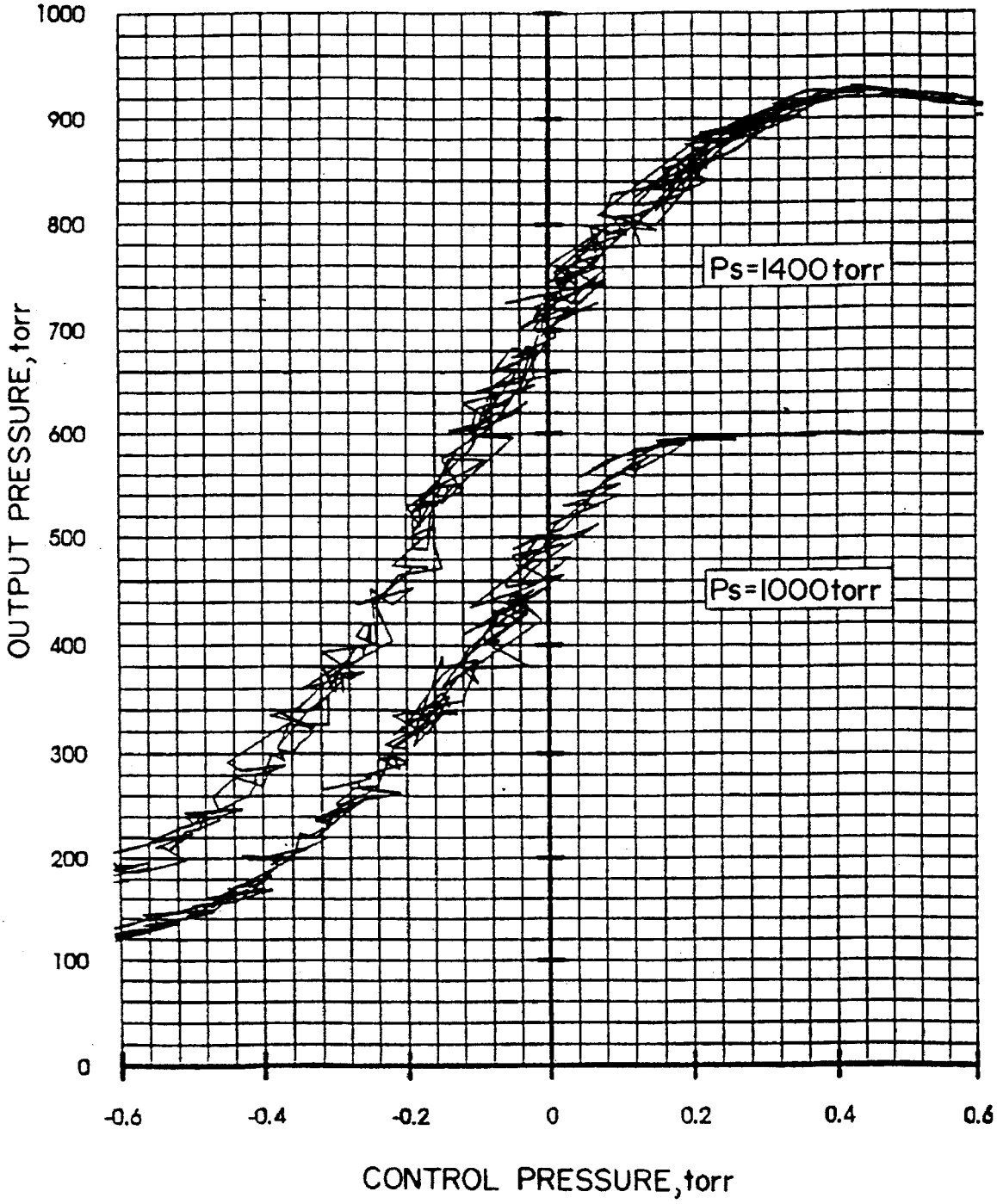
FIG. 4 (STATIC TRANSFER CHARACTERISTICS OF AN ACOUSTO-FLUIDIC DRIVER MODULE.)

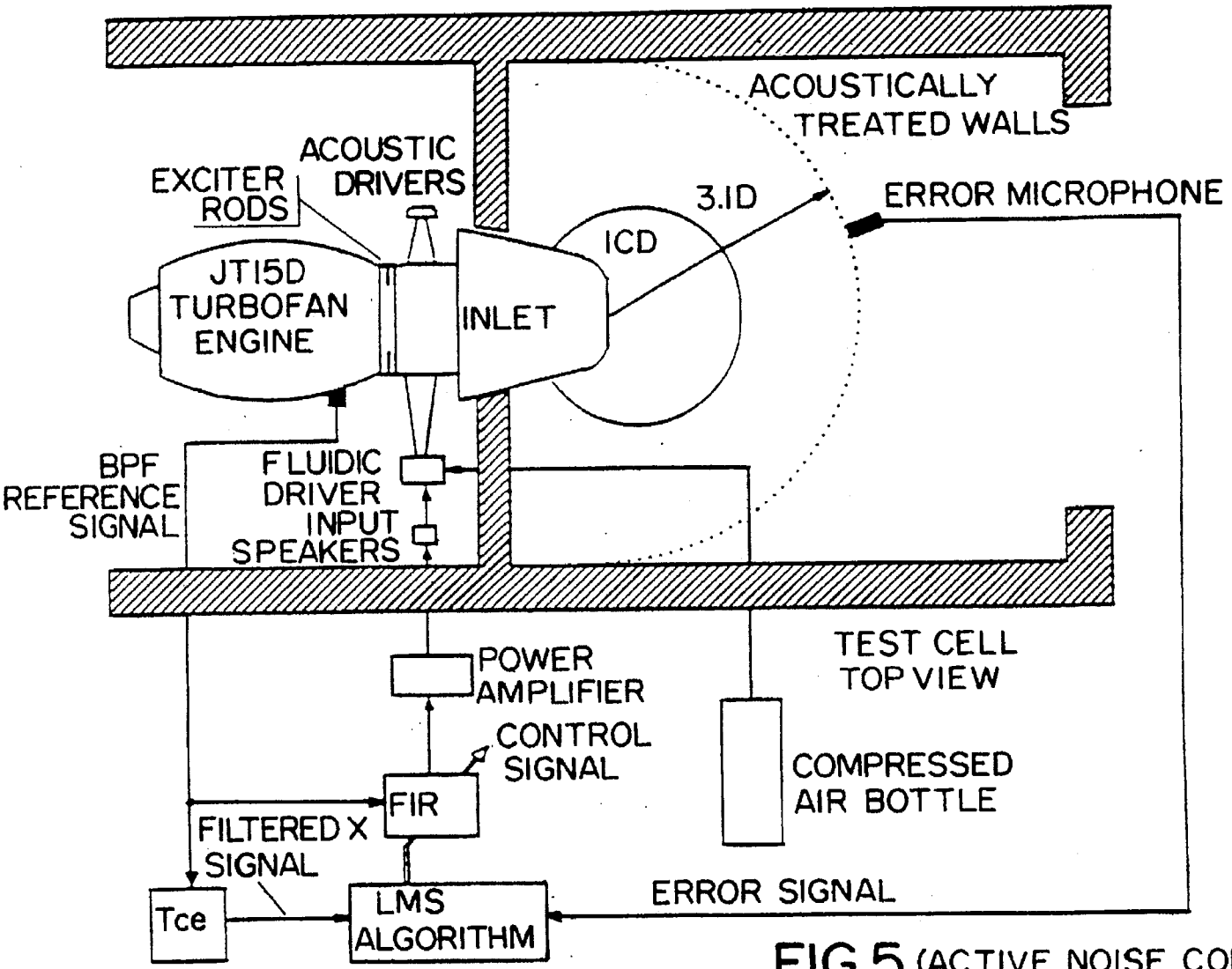
FIG.5 (ACTIVE NOISE CONTROL TEST CELL.)

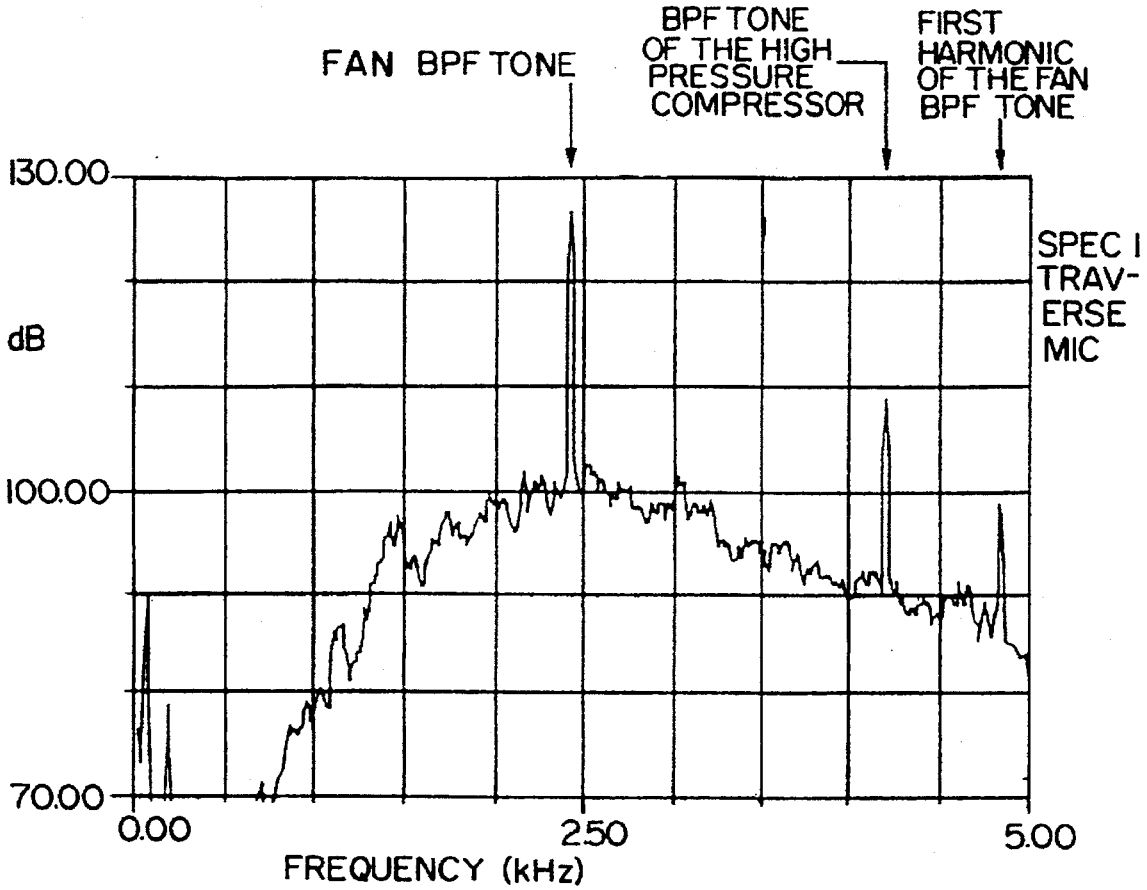
FIG.6A (UNCONTROLLED TURBOFAN ENGINE RMS SPECTRUM SHOWING 126.7dB BPF TONE.)
FIG.6B (CONTROLLED RMS SPECTRUM SHOWING BPF TONE AT 119.6dB.)
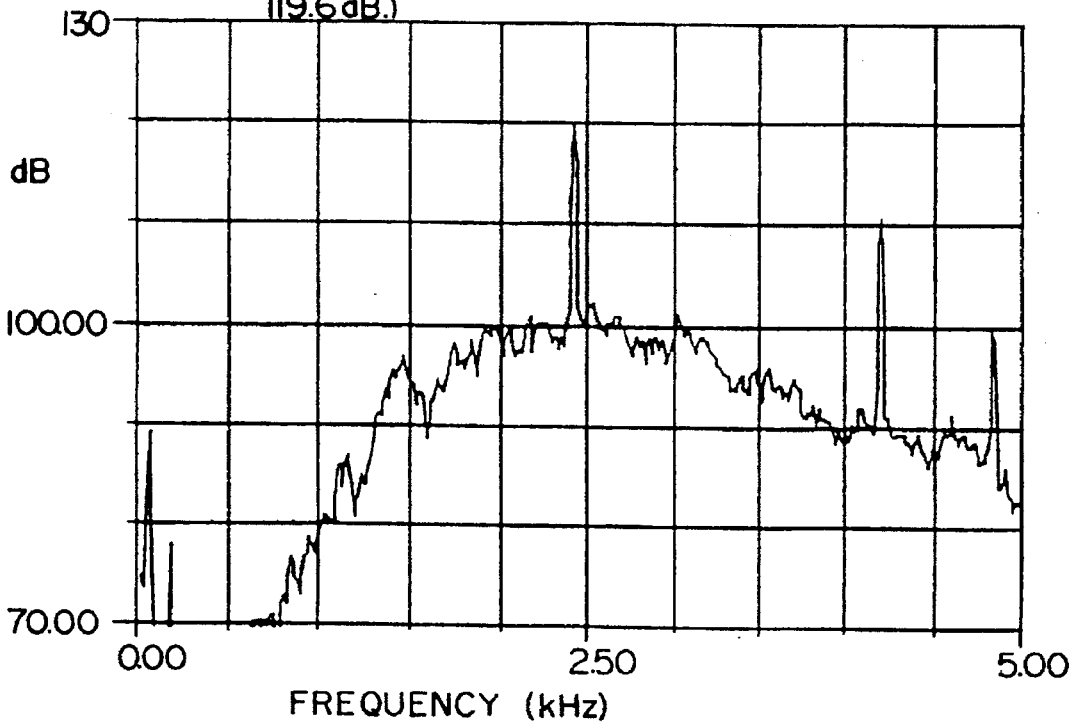

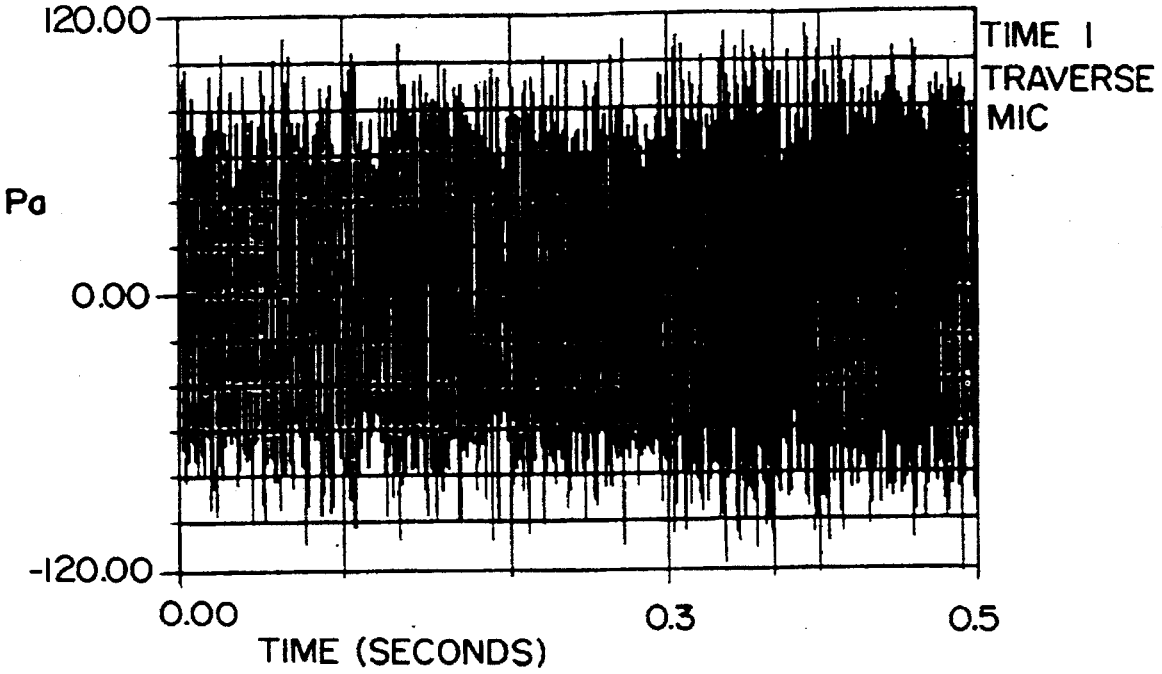
FIG. 7A (UNCONTROLLED ENGINE NOISE.)
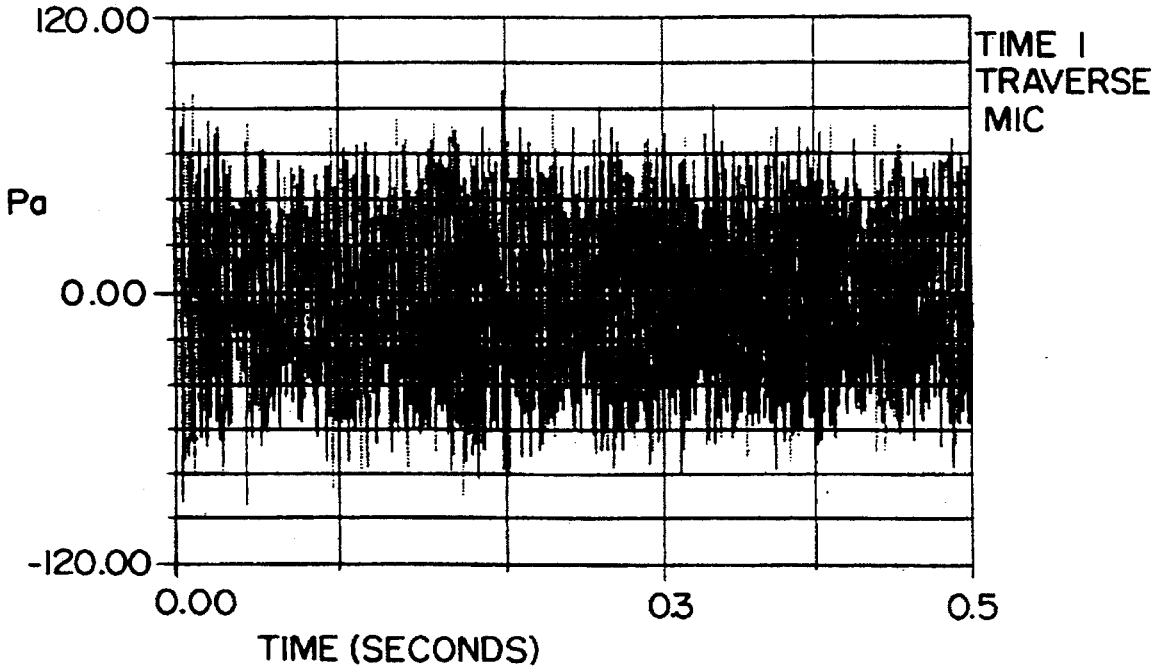
FIG. 7B (CONTROLLED ENGINE NOISE.)

ACOUSTO-FLUIDIC DRIVER FOR ACTIVE CONTROL OF TURBOFAN ENGINE NOISE

BACKGROUND OF THE INVENTION

1. Technical Field

The present invention relates to methods and apparatus for cancelling acoustic noise and, more particularly, to fluidic drivers for effecting noise cancellation.

2. Discussion of the Prior Art

Aircraft noise pollution is a topic of much debate and the subject of much research as well as legislation. The imposition of the Federal Aviation Administration (FAA) Stage 3 noise thresholds is a good example of this. Leading experts (Fotos, C. P., "Industry Experts Say NASA Must Devote More Resources to Civil Aeronautics," *Aviation Week and Space Technology*, p. 42, Feb. 24, 1992), however, agree that current quieting and control technology will be inadequate if stage three levels are to be met or exceeded economically. As by-pass ratios, and hence fan sizes, increase, turbofan engine fan noise components also increase. Passive noise reduction has been quite successful with significant reductions in fan tone levels, however, in the future, only incremental improvements can be expected to occur, because the much shorter inlet length state-of-the-art engines will not be able to accommodate the increased passive liners which would only have restricted space. As a result industry is looking to active control techniques to provide the necessary reduction in noise levels.

Active control of sound has shown great promise for a number of many applications (Williams, J. E. F., "Anti-Sound," *Proc. Roy. Soc.*, A 395, pp. 63–88, 1984; Fuller, C. R., et al., "Active Structural Acoustic Control with Smart Structures," *Proc. SPIE Conference on Fiber Optic Smart Structures and Skins II*, pp. 338–358, 1989; and, Elliot, S. J., and Nelson, P. A., "The Active Control of Sound," *Electronics and Communication Engineering Journal*, pp. 127–136, August 1990). Examples of the use of active noise cancellation can be found in such day-to-day applications as audio systems including microphones and headphones that eliminate background noise. The basic principle behind active noise suppression is that of destructive interference. Unwanted sounds are cancelled out by out-of-phase interaction with a control sound generated by acoustic drivers operated by sophisticated computer algorithms that predict the required amplitude and phase. In particular, noise that has a well-defined periodic nature is readily attenuated. By measuring the amplitude and phase of the unwanted signal, and then generating counter-sound that is 180° out of phase and projecting the counter-sound into the field, reductions of as much as an order of magnitude in sound pressure level can be achieved.

Research performed by the Virginia Polytechnic Institute (VPI), under NASA-Langley sponsorship, using conventional acoustic driver technology (i.e., very heavy compression drivers) is described in Thomas, R. J., Burdisso, R. A., Fuller, C. R., O'Brien, W. F., "Active Control of Fan Noise from a Turbofan Engine," AAIA No. 93-0597, 31st Aerospace Sciences Meeting & Exhibit, Jan. 11–14, 1993, pp. 1–9. The entire disclosure in this Thomas et al publication is incorporated herein by reference. The tests described therein have conclusively demonstrated that the periodic whine of turbofan noise (both primary frequency and first harmonic) from a real, commercial engine (Pratt and Whitney JT15D-1) radiated forward from the inlet, can be successfully reduced by as much as 20dB both on-axis as well as within a 60° forward angle. However, in any practical application, the heavy and expensive compression type acoustic drivers, and awkward, long, radially disposed, exponential horns used in that preliminary research would not be sufficiently rugged and reliable to withstand the real environment. In future engines, with lower blade passage frequencies, even larger and heavier electronic drivers would have to be used, and the poor reliability of the moving parts would be a problem in commercial engines. In addition, the electrical power requirement to drive these compression drivers would require a dedicated source of electrical power.

Fluidic control systems in operational turbofan engine applications such as the thrust reverser control on the General Electric CF-6 engine, using compressor-bleed air for its power, have demonstrated incredible reliability as measured by a mean-time-before-unscheduled maintenance in excess of 650,000 hours. This performance, demonstrative of the reliability one might expect of aerospace applications of fluidics, is orders of magnitude better than that of conventional electro-mechanical systems.

Sound can be amplified fluidically, more specifically by acousto-fluidic amplifiers, as disclosed in co-pending U.S. patent application Ser. No. 08/340,899, filed Nov. 15, 1994, now U.S. Pat. No. 5,540,248, by Drzewiecki and Phillippi and entitled "Fluidic Sound Amplification System". The entire disclosure in that patent is expressly incorporated herein. In particular, low level sound waves provided by a low power electro-mechanical source, such as a headset earphone, impinge on a high velocity gas power jet and deflect it slightly, producing a larger deflection downstream. This results in larger recovered pressure changes than the pressure changes in the low level sound at the root of the jet, resulting in amplification as well-known in the art of fluidics. By serially amplifying the signal with several acousto-fluidic amplifier stages in series, where the output pressure of one stage drives the next, acoustic gain of the order of 1000:1 (60dB) or greater is readily attained. Because the dynamic response of these fluidic amplifiers depends to a great extent on the time it takes the power jet fluid to transit from the power jet nozzle exit to the output channels, which can be as low as several (10–100) microseconds, the frequency response of amplifiers staged in such a manner can be in excess of 10,000 Hz. By feeding the amplified output sound into a compact (folded or coiled) horn which matches the impedance of the acousto-fluidic amplifier output to the surrounding atmosphere, the sound can be transmitted to the outside or ambient environment with little loss in power or sound level. Since fluidic amplifiers are comparatively light in weight, inexpensive and have no moving parts, they are particularly attractive for these types of applications.

OBJECTS AND SUMMARY OF THE INVENTION

It is therefore an object of the present invention to provide a method and apparatus for actively cancelling turbofan-generated noise with acoustic signals generated by small, lightweight, compressor-bleed-air-powered, no-moving-parts, acousto-fluidic amplifiers instead of heavy electro-mechanical drivers.

It is another object of the present invention to provide amplification of computer-generated sounds capable of interfering with unwanted sounds by using acousto-fluidic amplification, and processing the computer-generated audio and acoustic signals without the use of any electrical, electronic or mechanical means. This is accomplished in the present invention by the use of the sound-modulated flow of a gas in a fluidic circuit powered solely by pneumatic or gas pressure.

It is a further object of the invention to provide for a method and apparatus for broadcasting amplified sound into turbofan engine spaces and further radiating the sound out to distances of the order of several meters in order to attenuate, control, or otherwise cancel the harmful or undesired whine created by the passage of turbofan blades past engine stators.

Yet a further object of this invention is to provide a method and apparatus for broadcasting a large number of different sounds over a large area by distributing the sound among a plurality drivers to cancel multiple frequencies and harmonics of undesired sound.

An advantage of the invention is that the acousto-fluidic part of the system operates without any mechanical moving parts, including diaphragms, membranes or pistons, in amplifying and processing the audio signals. Further, the system operates with pneumatic power provided by bleeding flow from the compressor of a turbofan engine without materially affecting or degrading the performance or efficiency of the engine.

Finally, it is still another object of this invention to provide high gain, high power acousto-fluidic amplifiers that are not sensitive to the mechanical imperfections normally associated mass-produced fluidic integrated circuit laminations yet have a good low frequency and DC response without compromising the gain/amplifying means.

The above and still further objects, features and advantages of the present invention will become apparent upon consideration of the following detailed description of specific embodiments thereof, especially when taken in conjunction with the accompanying drawings wherein like reference characters in the various figures are used to designate like components.

BRIEF DESCRIPTION OF THE DRAWINGS

FIG.2 is a plot of the amplitude and phase versus frequency response of an acousto-fluidic amplifier employed in the present invention.

FIG. 3 is a plot of the flow consumption (i.e., supply flow versus supply pressure) of an embodiment of an acousto-fluidic driver utilized in the present invention.

FIG. 4 is a plot of the static transfer characteristic (i.e., output pressure versus control pressure) of an embodiment of an acousto-fluidic driver utilized in the present invention.

FIG.5 is a diagram of a test setup used to test the acousto-fluidic active noise control system of the present invention.

FIG. 6*a* is a plot of the uncontrolled frequency spectrum of noise generated by a Pratt and Whitney JT15D turbofan engine.

FIG. 6*b* is a plot of the frequency spectrum of noise generated by a Pratt and Whitney JT15D turbofan engine after it has been controlled by the acousto-fluidic noise control system of the present invention.

FIG. 7*a* is an uncontrolled time trace of noise generated by a Pratt and Whitney JT15D turbofan engine.

FIG. 7*b* is a time trace of the noise generated by a Pratt and Whitney JT15D turbofan engine after it has been acted upon by the acousto-fluidic noise control system of the present invention.

FIG. 10*a* is a diagrammatic side view in elevation of a horn terminated with a honeycomb/membrane structure suitable for use with the present invention.

FIG. 10*b* is a front view in elevation of the horn of FIG. 10*a*.

DESCRIPTION OF THE PREFERRED EMBODIMENTS

Figure 1:
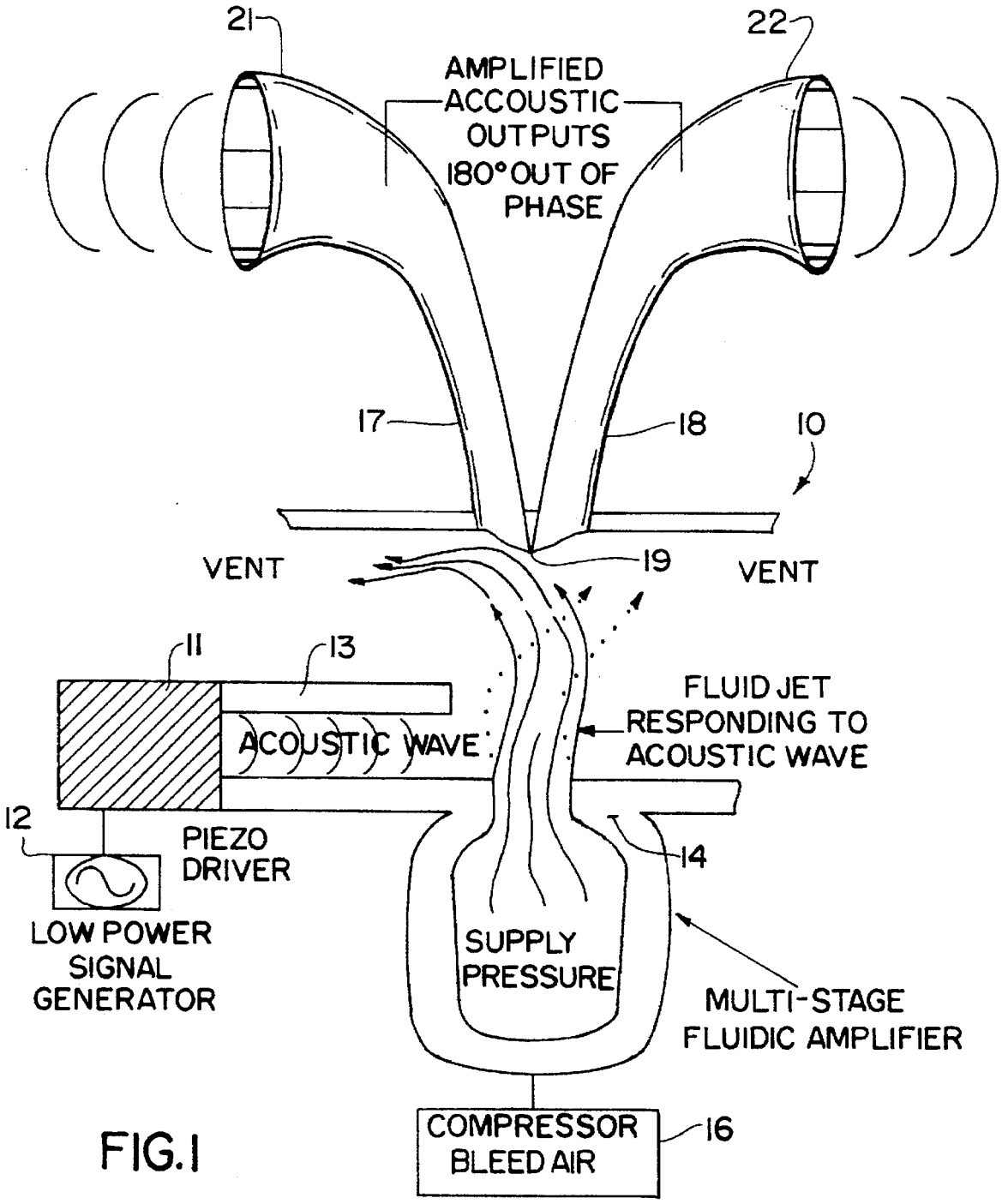
FIG.1 is a schematic illustration of an acousto-fluidic driver of the type used in the noise cancellation system of the present invention.
Figure 1A:
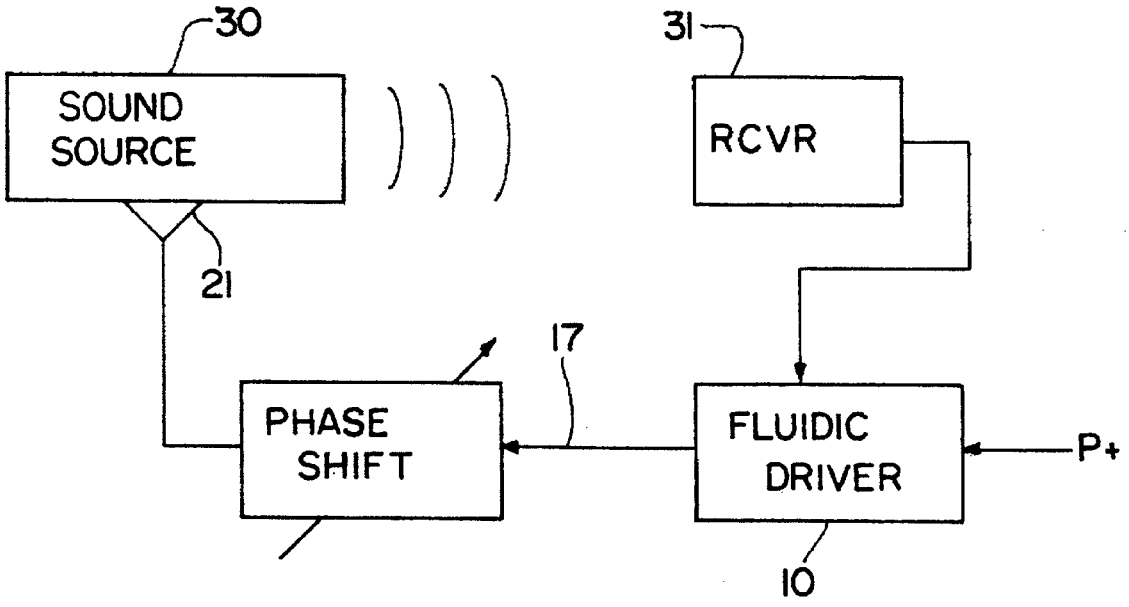
FIG.1*a* is a functional block diagram of a simplified embodiment of the noise cancellation system of the present invention.
Figure 1B:
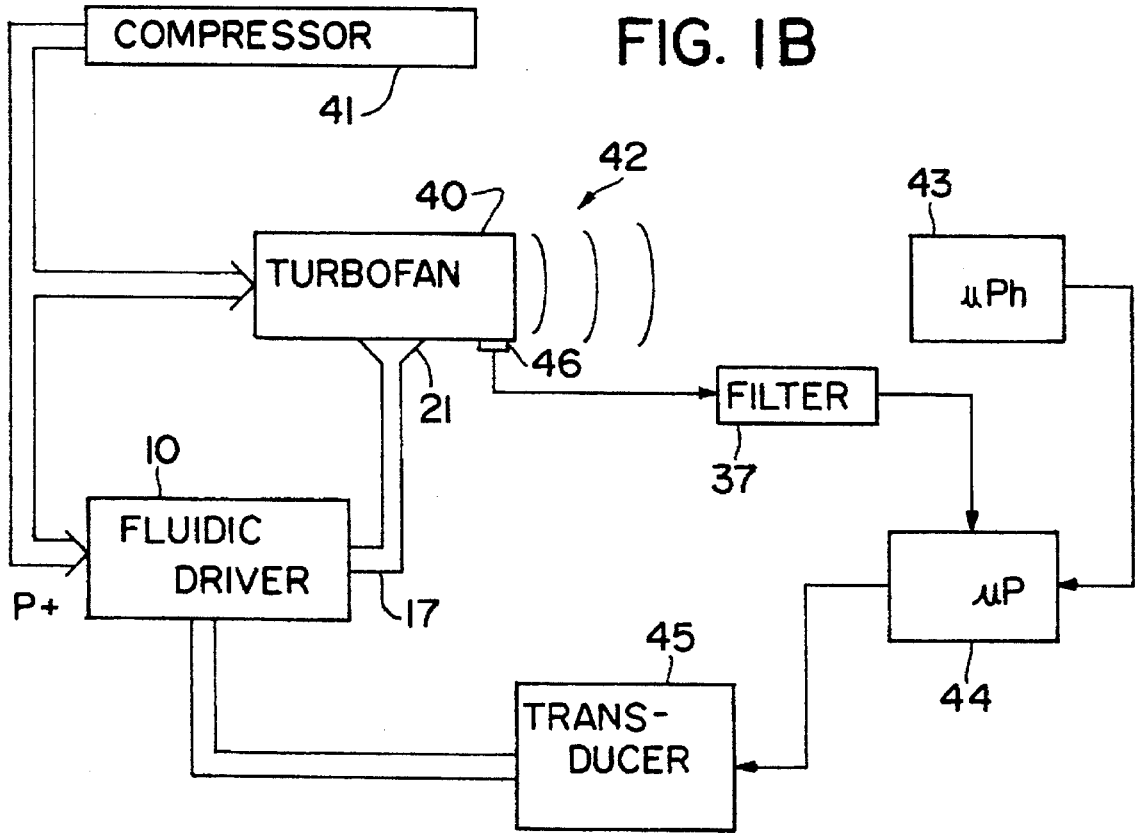
FIG.1*b* is a functional block diagram of a more sophisticated embodiment of the noise cancellation system of the present invention.

The broad principles of acousto-fluidic noise cancellation according to the present invention are illustrated in FIGS. 1, 1*a* and 1*b*. Specifically, a piezoelectric driver 11 is caused to vibrate by an applied audio signal from generator 12 and produces corresponding acoustic vibrations in the inlet or control part 13 of a fluidic amplifier 10. The acoustic vibrations impinge upon a high velocity gaseous fluid jet issued from a power nozzle 14 of amplifier 10. The power nozzle is shown supplied with pressurized gas from a compressor 16. The impinging acoustic vibrations deflect the jet slightly, the deflection angle and frequency being substantially proportional to the amplitude and frequency, respectively, of the acoustic vibrations. Downstream of the point of impingement the actual distance or amplitude of deflection of jet deflection is considerably greater, although the angle is the same so that the differential pressure sensed between the amplifier outlet passages 17, 18 is considerably larger than the amplitude of the acoustic vibrations causing the jet to deflect. Outlet passages 17, 18 are disposed on opposite sides of a flow divider 19 to receive varying portions of the jet as it deflects, the variations in pressure in the two outlets being opposite in phase to provide a differential pressure. The amplified output differential pressure is applied from passages 17, 18 to respective horns 21, 22 configured to match the output impedance of the amplifier to the surrounding atmosphere, thereby resulting in little loss of power or sound level. The horns 21, 22 emit respective amplified acoustic signals of opposite phase. If the acoustic input wave applied to control passage 13 is derived from a source of acoustic noise to be cancelled, the acoustic output signals from the horns may be directed to oppose and cancel that noise.

A conceptual block diagram illustrating the principals of the present invention is presented in FIG. 1*a* to which specific reference is now made. A source 30 of unwanted acoustic energy radiates the unwanted sound forwardly where it is picked up by a sound receiver 31. The acoustic energy arriving at receiver 31 may be directly applied as a controlled input signal to fluidic driver amplifier 10. Alternatively, receiver 31 may be a microphone which transduces the acoustic energy to an electrical audio signal, the latter being capable of transmission over a greater distance without amplification than is the case for an acoustic signal. The audio signal can be converted back to an acoustic signal at the fluidic amplifier input port by means of a suitable electronic-to-acoustic transducer, for example a piezoelectric driver, such as described above in relation to FIG. 1. In either case, the resulting acoustic signal, representing the noise to be cancelled, deflects a power jet in fluidic amplifier driver 10 to provide an amplifier output pressure signal at horn 21. The horn delivers its acoustic output signal to the sound source 30 in phase opposition to the radiated sound at the delivery point, thereby cancelling the sound. Referring temporarily back to FIG. 1, it is noted that the pressure signal appearing in output passage 17 and delivered to horn 21 is of opposite phase to the deflecting input signal applied to control port 13. Accordingly, ignoring acoustic delays, it is seen that an out-of-phase signal can be delivered back to the sound source in phase cancelling relation, depending upon the point of delivery. In other words, if the output pressure signal is delivered by horn 21 rather than by horn 22, and if horn 21 is positioned so that all of the audio and acoustic delays between receiver 31, driver 10 and horn 21 produce a negligible phase shift (or a phase shift that is a multiple of 360°), then the acoustic signal delivered by the horn will cancel the undesired noise. On the other hand, any significant phase shift can be balanced out, either empirically for each installation or by pre-calculation, with an adjustable phase shifter 32 located in the output pressure signal line from driver 10. Phase shifter 32 is typically a conventional filter for fluid signals made up of a combination of flow inertance, restriction and/or volume elements, only one of which needs to be adjustable if phase adjustability is desired. Alternatively, the phase shift may be effected electrically in the audio input signal if receiver 31 is a microphone.

A more sophisticated embodiment of the invention is illustrated in FIG. 1*b* wherein a turbofan type engine produces unwanted acoustic noise patterns 42 to be cancelled. The noise pattern 42 is received by a microphone 43 arranged to deliver its audio output signal to a microprocessor 44 programmed to provide an output signal at suitable phase and frequency to drive the fluidic driver 10 by means of a voltage-to-pressure (or current-to-flow) transducer 45. Microprocessor 44 can be used to adjust for the various system delays so as to accurately present the acoustic signal from horn 21 in phase opposition to the noise pattern at the location of the output end of the horn. For even greater accuracy in cancelling the relatively complex frequency spectrum of noise produced by turbofan 40, microprocessor 44 can be programmed to process input signals in accordance with a least-mean-square algorithm of the type described in detail in the aforementioned Thomas, et at. publication. When so programmed, microprocessor 44 and the associated components serve as a feedforward control. For this mode of operation an audio reference signal at the blade passage frequency of turbofan 40 is picked up by a microphone 46 and delivered through a filter 47 to the microprocessor, serving to synchronize the microprocessor and its control signal to the dominant noise-producing frequency components. This arrangement is described below in somewhat greater detail in relation to FIG. 5. The present invention does not reside in the particular algorithm employed in connection with microprocessor 44, or in any specific processing circuitry used to assure that the phase of the acoustic signal from fluidic driver 10 is properly phased to effect noise cancellation. Such techniques are, to some extent, known and, in any event, are well within the skill of persons familiar with the art of noise cancellation. Rather, the invention resides in the use of fluidic drivers to provide the acoustic control signal, the phase of which can be adjusted either manually or automatically in any of a multitude of ways. The fluidic driver may be a single stage or, for more effective operation, or for different applications, multiple cascaded or parallel-connected stages.

In considering the engine noise cancellation embodiment of FIG. 1*b*, periodic engine noise (whine) is generated during passage of the turbofan rotor past the stator, and eddies shed by the rotor blades impinge on the stationary surfaces of the stators. This sound radiates both forward, out of the engine inlet, and backward, out of the engine exhaust. In general, the sound radiated through the exhaust is less coherent than that radiated forward because of turbulent mixing in the high energy exhaust stream, and it is also muffled by the higher free-stream noise. The sound radiated forward is called engine inlet noise and is characterized by a discrete tonal frequency called the blade passage frequency (BPF) tone. It is the level of this sound that has been reduced by one embodiment of the present invention. Typically this sound level is on the order of 120dB (referenced to 20μPa) at about two meters away from the inlet. By using an upstream sound sensing means, e.g., a microphone or an acousto-fluidic transducer, the BPF tones to be reduced can be sensed and referred to a BPF reference sensor that detects the passage of the rotor blades. This fixes the phase relationship of the sound generated to that sensed. Using this information, a microprocessor can predict the frequency and amplitude of the signal with which the acousto-fluidic driver must be actuated in order to produce a counter-sound wave that is near in amplitude and is out of phase with the radiated BPF tones. The acousto-fluidic driver produces the desired anti-sound, and the noise radiated out of the engine inlet is effectively reduced.

In order that an acousto-fluidic driver be practical and viable to cancel high level engine noise, it must be capable of developing sound levels at the horn exit, (i.e., at the wall of the inlet of the turbofan engine) on the order of 150–160dB (referenced to 20μPa.). Levels that must be achieved within the acousto-fluidic amplifiers themselves must therefore reach 175–185dB. In accordance with one aspect of the present invention, fluidic amplifiers originally designed to operate at low pressures (i.e., in the laminar flow regime) are operated successfully at high pressures that develop turbulent supersonic flows, with little loss in gain but immense increase in frequency response. This results in recovery of remarkably high acoustic pressures. A standard integrated circuit fluidic amplifier operating at 30 psig has been shown to be able to develop a ±3 psi peak-to-peak signal into a matched acoustic impedance, corresponding to 177dB SPL RMS. In order to use an ultra-low power, headset-type speaker which generates input signals of about ±0.004 psi peak-to-peak (113dB RMS), a gain in excess of 60dB is needed to achieve the desired output levels. A four-serial-stage gainblock module, consisting of a final, driving stage of sixteen parallel C/2-format amplifiers with 0.010in nozzle width and height provides a optimum power transfer match to the acoustic impedance of the standard 0.045-in diameter outlet port. C- and C/2-format are designations for standard U.S. Government integrated circuit fluidic laminations used to build amplifiers and circuits, (Joyce, J. W., "A Catalog of C-Format Laminates," Harry Diamond Laboratories Special Report, HDL-SR-83-2, March 1983), where the C/2-format is half the size of C-format. The total number of parallel amplifiers is dictated by the amount of power required to be radiated, but the maximum number of amplifiers that can be placed in parallel without losing power transfer efficiency is dictated by the size of the outlet port diameter. Thus, to obtain more power using standard C/2-format devices operating at 30psi, modules with 16-parallel amplifiers must be placed in parallel.

The preferred embodiment of the present invention utilizes a staging scheme of the general type described in the aforementioned Drzewiecki et al. patent, (U.S. Pat. No. 5,540,248 incorporated herein by reference) that keeps the interstage impedances constant in order to ensure maximum power transfer. By reducing the operating supply pressure of the driving stage relative to the output stage by four, and the number of parallel elements by two, and continuing this procedure in each stage, a low input pressure four-stage amplifier with very high dynamic range, a gain of over 60dB and a frequency response essentially flat to well past 5,000 Hz has been devised. FIG. 2 illustrates that the frequency response for the resulting amplifier not only is relatively uniform (i.e., within ±2dB), but that the bandwidth exceeds 5,000 Hz, which is more than sufficient to handle both primary as well as harmonic blade passage frequency (BPF) tones in a turbofan engine. Since fluidic amplifiers have two output channels, each putting out signals 180° out of phase with each other, the invention utilizes the technique of summing a lagged output disclosed by Drzewiecki et al. "Fluidic Sound Amplification System" and found that, in a relatively wide band (±50-percent of the frequency of interest) the output power could be doubled by delaying one output signal to generate an additional 180° of phase shift at 2,500 Hz and summing it in an equal area acoustic junction with the other output signal. This provides an effective twofold increase in sound pressure level, or 6dB.

The acousto-fluidic gainblock used in the preferred embodiment should not be construed to be the optimum design; rather, it merely represents what can be achieved using existing technology components. By customizing the lamination topology to provide for larger exit openings, for example, more parallel amplifiers could be accommodated in a single module, thereby reducing the number of modules required to generate the desired amount of acoustic power. Indeed, it is advantageous to increase the overall number of parallel stages throughout the module because that reduces the effects of mechanical imperfections which could lead to non-symmetrical output signals and possibly null oIfsets that are large enough to saturate the amplifier, thereby reducing the gain to levels below which the device is effective. In the described four-stage configuration using two parallel amplifiers in the first stage, four in the second, eight in the third and sixteen in the fourth, null offset propagation is minimized by having two well-matched parallel amplifiers, with their offsets cancelling one another, in the first stage, as well as having the first stage pressure a factor of sixty-four lower than the last stage. The large number of parallel amplifiers in each succeeding stage further minimizes null offset propagation. By reducing the first stage output offset pressure to less than one-percent of the 20 mm Hg first stage supply pressure (e.g., 0.2 mm Hg), even when this is amplified by the gain of 160 of the last three stages, the result is less than 32 mm Hg out of a greater than 500 mm Hg output span. This, then, does not materially affect the amplifier's operation.

FIG. 3 illustrates the measured flow consumption of a single acousto-fluidic module, demonstrating that the flow consumption at 20 psi (1,000 torr, torr=mm Hg) is about thirty-two liters per minute. FIG. 4 illustrates the static transfer characteristic showing the measured output pressure as a function of the applied control pressure. The slope of this curve represents the gain and is over 1000:1. Also, this plot shows that the signal needed to saturate the output signal is about ±0.4 mm Hg, corresponding to an input RMS sound level for saturation of about 125dB, a level that is readily developed by miniature voice coil speakers such as found in stereo headsets. It is also a level that is readily developed acousto-optically by light (e.g., laser) energy impinging on a broadband absorber and amplified by one or two stages of acousto-fluidic amplifiers as shown in U.S. Pat. No. 4,512,371, the disclosure of which is incorporated herein. In such an embodiment, the sound to be cancelled is picked up by a microphone, as described above, and the resulting audio signal is used to modulate the intensity of a light beam generated, for example, by a laser. The modulated light beam is directed (for example, by an optical fiber) to a photo-acoustic cell of the type described in the aforementioned U.S. Pat. No. 4,512,371. That cell absorbs the light energy and converts it to heat energy, thereby creating pressure pulses in the cell that are delivered to the fluidic driver and amplified. Thus, in the event that it is desired to eliminate any and all moving parts, an optical fiber could be used to transmit the command signal to the acousto-fluidic driver modules, and could be directly incorporated as part of the circuit.

Using the described four-stage gainblock as a building module, a modular acousto-fluidic driver, composed of eight multiple parallel integrated circuit gainblocks, each driven by a miniature voice-coil earphone, was found to be capable of delivering sufficient acoustic power to significantly reduce the BPF tones in a JT15D turbofan engine. The general characteristics of one module are:

| | |
|---|---|
| • Acoustic power | 5.4 watts, summed outputs |
| • Flow consumption | 37.7 lpm ($1.7 \times 10^{-3}$ lb/sec) @ 1400 mmHg |
| • Weight | 125 gm (4.4 oz) |
| • Size | 23 × 23 × 50 mm (0.9 × 0.9 × 2.0 in) |
| • Sound Pressure Level | 116 dB @ 2.4 m, 8 modules w/ 3½-in horn. |
| • Input | Radio Shack Monaural Earphone |

In the experimental test setup shown in FIG. 5, described in detail in the Thomas et al. publication for use with compression drivers, counter-sound is injected into the engine with eight fluidic driver modules feeding a single exponential horn 60 that exits into the engine with a $2in^2$ (3⅛in×¾in) opening. Unfortunately, that horn was poorly matched to frequencies below 4,000 Hz and resulted in delivered signal levels 8dB less than ideal. Nevertheless, on the JT15D turbofan engine, operating at idle but with the BPF tones augmented to levels equivalent to those that would be expected at full engine power by using eddy-shedding exciter rods in the proximity of the stators as described in the Thomas et al publication, the BPF tones (engine whine) at 2,412 Hz were reduced by more than 7dB (a factor of 2.2) at one selected position in the far field. Specifically, FIGS. 6*a* and 6*b* show the RMS spectra of the engine noise before being controlled (FIG. 6*a*) and after being controlled (FIG. 6*b*), and two frequency spikes can be seen. Control, for purposes of the subject test, was applied to reduce the amplitude of the 2,412 Hz tonal only. The reduction can be seen in FIG. 6*b* in that the height of the spike is reduced, the reduction being clearly audible during the test. FIG. 7*a* is a time trace of the amplitude of the uncontrolled engine noise, basically the signal that the ear hears, and FIG. 7*b*, a time trace of the controlled engine noise amplitude, shows the level reduced by a clear factor of two; this was readily perceived by the human ear. To extend the area or angular coverage of tonal reduction, a multiplicity (e.g. twelve) of drivers, disposed circumferentially around the engine inlet, would serve the purpose. With a 7dB reduction in BPF tone noise with a single driver, one would then expect a reduction of over 20db (a factor of ten) with an array of twelve drivers, which would also extend the global control, i.e., through a larger radiation cone.

The LMS algorithm illustrated in FIG. 5 was used to generate the accurate counter-sound and is a single-channel, time-domain filtered-x LMS algorithm described in detail in the Thomas, et al publication. Use of this algorithm successfully demonstrated operation of the system.

With proper impedance matching and design of the horn, this same eight-module driver would provide 6–8dB more of sound suppression. Horns can be designed to be conformal with, cast or machined in the engine. They do not have to be very long, as the cutoff frequency needs only to be somewhat lower than the lowest frequencies of interest (1,000 Hz). These lower frequencies are expected to be generated in large ultra-high bypass engines. The exit area of the horn in the disclosed embodiment should be increased to an effective diameter of greater than 3½-in to achieve proper transfer of acoustic power at frequencies of the order of 2,000 Hz. In order that a plurality such large openings in the side wall of the engine inlet not introduce undesirable effects, such as flow disturbances and eddy shedding (which could alter the inlet flow distribution and counter-productively increase the engine noise), a practical horn implementation can be terminated with an acoustically transparent covering, such as a thin membrane supported by a short honeycomb structure. This will not attenuate or affect the output sound levels, and will minimize flow disturbances by presenting a smooth flow surface. The thin membrane can be speaker cloth which permits the DC outflow of air from the fluidic amplifier outlet passages. FIGS. 10*a* and 10*b* illustrate such an implementation, wherein the horn may be terminated by a combination of a honeycomb structure and cloth covering. The honeycomb structure is a thin wall honeycomb having its passages of hexagonal section oriented in the direction of sound and air propagation. The cloth covering covers the downstream end of the honeycomb structure and the outlet end of the horn.

Based on the measured flow consumption (0.0017 lb/sec) of a single module of the described embodiment, twelve such eight-module drivers, using air that is bled from the turbofan engine compressor to provide the fluidic power, would consume 0.08 lb/sec of air, corresponding to less than two-thirds of one-percent of the 27 lb/sec of actual engine flow for the JT15D engine. Such a low flow demand would have little or no effect on the efficiency or performance of the engine, and constitutes less than the flow normally used to purge the cabin of a commercial jet airplane.

The weight of an eight-module acousto-fluidic driver configured as described is less than two pounds. This could be reduced by choice of materials (e.g., aluminum as opposed to steel); however, compared with a pair of prior art 100W electromagnetic compression drivers each weighing over 10 lbs, a tenfold lighter system is provided which would not add materially to the flight weight of the engine.

Figure 8B:
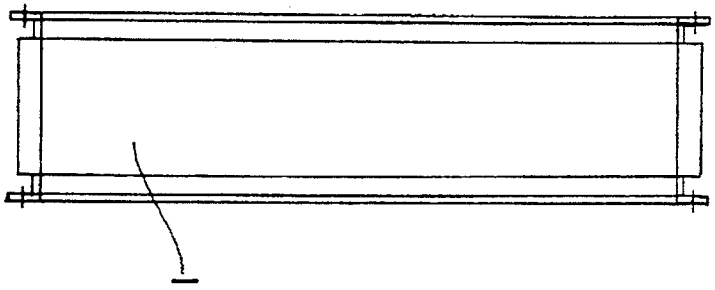
FIG. 8*b* is a side view in elevation of the turbofan inlet of FIG. 8*a*.
Figure 8A:
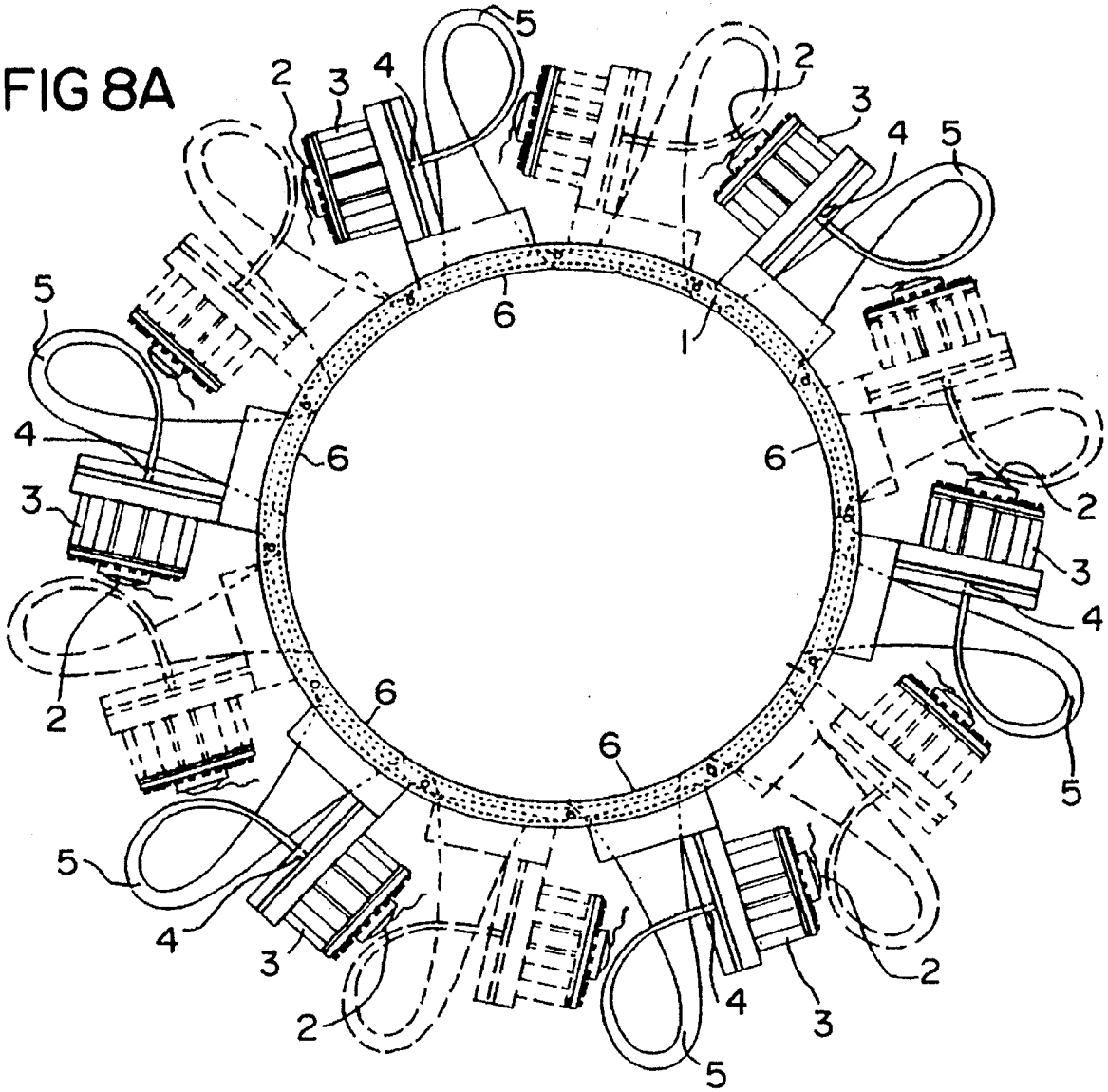
FIG. 8*a* is a front view elevation of an embodiment having twelve acousto-fluidic drivers disposed circumferentially about the inlet of a turbofan engine.

FIGS. 8*a* and 8*b* illustrate one particular embodiment of the invention using twelve acousto-fluidic drivers disposed in circumferentially equally spaced relation around a cylindrical section 1 of the inlet of a JT15D turbofan engine. The miniature electronic speakers 2, are each located in the center of eight acousto-fluidic driver amplifier modules 3, and the computer-generated sound is distributed equally through equal length paths to one control or input port of each driver module. Sound is also distributed to the opposite control ports through a longer path channel so that the signal at a desired frequency (typically the mid-frequency of the range of interest, e.g., 3,000±1,500 Hz) arrives approximately 180° out of phase. In this manner the input signal is presented differentially to the amplifier, and its amplitude is approximately doubled at the center frequency but is only down a factor of two (6dB) at the extremes of the band of interest. This arrangement provides for isolation of the inputs from external disturbances and spurious input noise. The acousto-fluidic modules 3 amplify the sound and the two out-of-phase output signals are collected (i.e., summed) with the same phase-lagging scheme described above. The summed output signals are fed into the throat 4 of a matching coiled horn 5. The horns 5 are coiled to minimize their protrusion from the engine and to minimize the size of the outer envelope of the engine. Output sound radiates from the horn mouths 6 into the inlet section 1 and cancels the unwanted BPF tones being radiated forward from the turbofan blades and stators.

Figure 9:
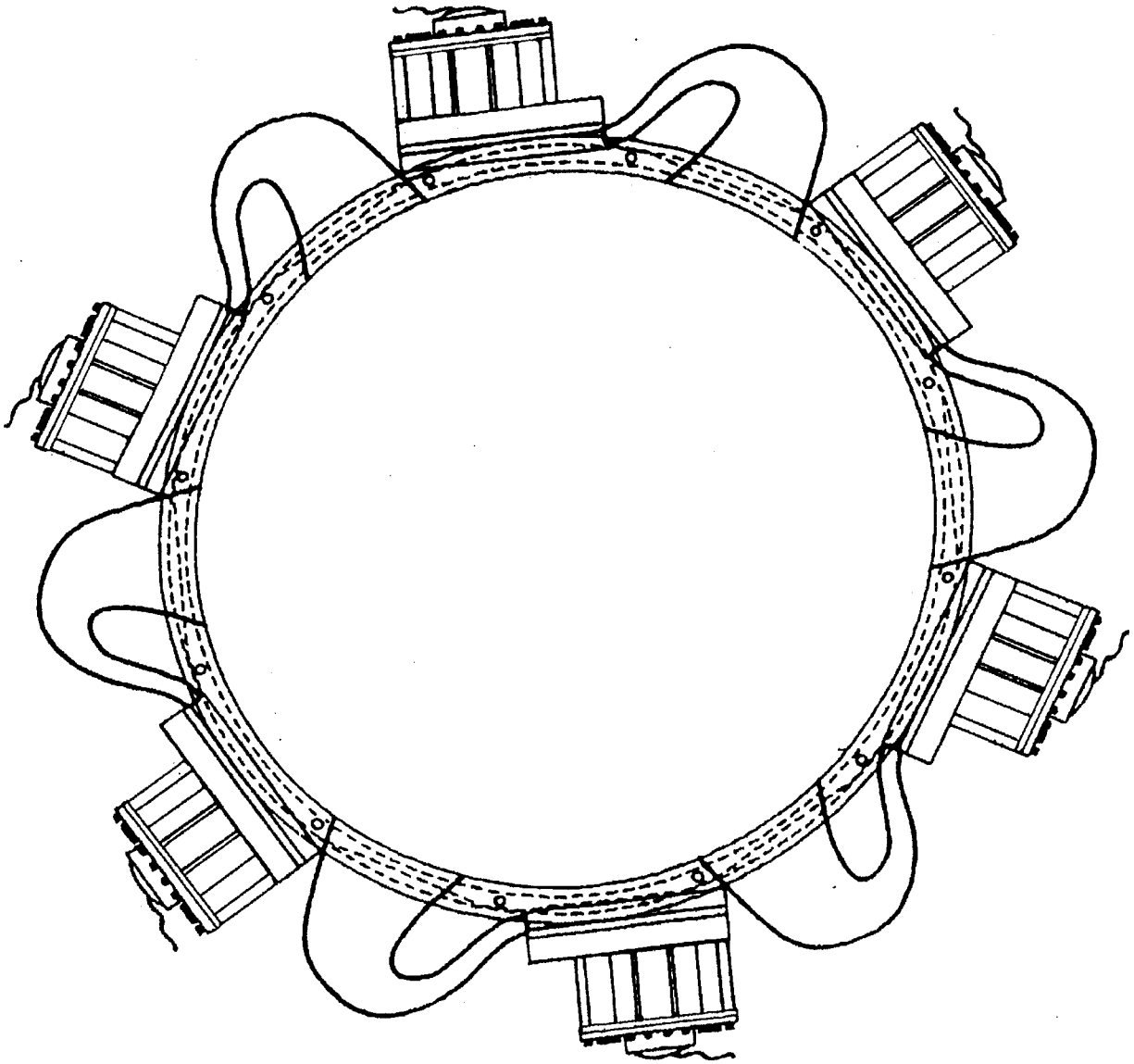
FIG. 9 is a front view in elevation of an embodiment having six acoustic-fluidic drivers with conformed horns disposed circumferentially about the inlet of a turbofan.

The horns may alternatively be conformally wrapped about the engine as illustrated in FIG. 9 wherein six acousto-fluidic drivers are circumferentially equally spaced about a turbofan engine inlet.

The present invention makes available an improved active acoustic noise cancellation method and apparatus employing acousto-fluidic amplifiers to reduce the size, cost and weight from that of conventional noise cancellation systems. The invention has particular utility in reducing jet engine noise, but should not be construed as so limited since the principles described herein apply to reducing noise in substantially any noisy environment.

Inasmuch as the present invention is subject to many variations, modifications and changes in detail, it is intended that all subject matter discussed above or shown in the accompanying drawings be interpreted as illustrative only and not be taken in a limiting sense.

What is claimed is:

1. The method of reducing noise emanating into an environment, said method comprising the steps of:

(a) sensing acoustic energy in said environment;

(b) providing an acoustic input wave proportional to the sensed acoustic energy;

(c) in response to said acoustic input wave, generating, via fluidic amplification, a fluidically amplified sound signal proportional to the sensed acoustic energy, without using mechanical moving parts and electronic components to effect amplification;

(d) delivering said amplified sound signal to a location in said environment wherein the and amplified sound signal is in phase opposition to said noise to thereby destructively interfere with and cancel said noise.

2. The method of claim 1 further comprising the step of impedance-matching the amplified sound signal to said environment at said location.

3. The method of claim 2 wherein step (d) includes the step of delivering said amplified sound signal from multiple circumferentially spaced locations in said environment to cover a broad area within said environment.

4. The method of claim 1 wherein step (c) includes independently driving a plurality of different acousto-fluidic amplifiers with respective different components of said; noise in order to cancel different frequency components of said noise with respective amplified sound signals.

5. The method of claim 1 wherein said noise is generated by a turbofan engine driven by an air compressor, and wherein step (c) includes fluidically amplifying said noise by deflecting a power jet of air, derived from said compressor, with said acoustic wave representing the sensed acoustic energy from step (a).

6. Apparatus for reducing noise emanating from a source into a predetermined environment, said apparatus comprising:

sensing means for sensing acoustic energy in said environment;

input means for providing an acoustic input wave proportional to said sensed acoustic energy;

fluidic amplifier means responsive to said acoustic wave for generating, via fluidic amplification, a fluidically amplified sound signal proportional to the sensed acoustic energy; and delivery means for delivering said amplified sound signal to a location in said environment where the amplified sound signal is in substantial phase opposition to said noise to thereby destructively interfere with and reduce said noise.

7. The apparatus of claim 6 wherein said delivery means comprises horn means for matching said amplified output signal to said environment at said location.

8. The apparatus of claim 7 wherein said source is a jet engine having a housing, and wherein said horn means is integrated into said housing.

9. The apparatus of claim 7 wherein said source is a jet engine having a housing, and wherein said horn means is conformal to said engine housing.

10. The apparatus of claim 7 wherein said horn means has an exit area for said amplified sound, said exit area being covered with an acoustically transparent material.

11. The apparatus of claim 10 wherein said acoustically transparent material is a solid membrane supported by a honeycomb structure.

12. The apparatus of claim 11 wherein said acoustically transparent material is a porous cloth-like material supported by a honeycomb structure.

13. The apparatus of claim 6 wherein said fluidic amplifier means includes an acousto-fluidic amplifier comprising:

nozzle means for issuing a high pressure jet of gas;

a first inlet port for receiving an acoustic input signal corresponding to said acoustic wave, and directing the received input signal into deflecting relation with said jet; and outlet means for receiving varying portions of said jet as a function of deflections of the jet by said acoustic input signal.

14. The apparatus of claim 13 wherein said amplifier is a differential fluidic amplifier in which said output means comprises two outlet passages separated by a flow divider and arranged to receive said jet and provide differentially varying output pressure signals.

15. The apparatus of claim 14 further comprising:

means for delaying output flow in one of said two outlet passages by 180°; and means for connecting the delayed output flow in summing relation with the output flow in the other output passage;

whereby the inherent 180°-phase separation between the flows in the two output passages is effectively negated by the delay, and the two output flows are summed in an in phase relation at a predetermined frequency.

16. The apparatus of claim 13 wherein said fluidic amplifier includes:

a second inlet port for directing signals received therein into deflecting relation with said jet in opposition to said first inlet port;

lag means responsive to said sensed acoustic energy for providing a lag input signal in 180°-phase opposition to said acoustic input signal; and means for applying said lag input signal to said second inlet port.

17. The apparatus of claim 13 wherein said delivery means includes an impedance-matching horn having an exponential shape.

18. The apparatus of claim 13 wherein said delivery means includes an impedance-matching horn having a conical shape.

19. The apparatus of claim 13 wherein said source is a turbofan engine having a compressor stage, and further comprising means for bleeding gas from said compressor stage to said nozzle means to supply gas for said high pressure jet.

20. The apparatus of claim 6 wherein said acousto-fluidic means comprises multiple fluidic amplifiers connected in parallel.

21. The apparatus of claim 6 wherein said fluidic amplifier means comprises multiple fluidic amplifiers disposed in an array to deliver said amplified output signal from multiple locations in said environment.

22. The apparatus of claim 21 wherein a plurality of said multiple fluidic amplifiers are independently driven by different frequency components of said noise to cancel said different frequency components.

23. The apparatus of claim 22 wherein a plurality of said multiple fluidic amplifiers are independently driven at different phases of said noise to cancel different parts of said noise at different circumferential locations in said environment.

24. The apparatus of claim 6 wherein said source of noise is a turbofan engine having a housing, wherein said fluidic amplifier means comprises multiple fluidic driver amplifiers connected to provide multiple amplified sound signals, and wherein said delivery means comprises multiple respective horns for said multiple amplifiers, said horns being disposed in a circumferential array about said housing.

25. The apparatus of claim 24 wherein said delivery means comprises multiple axially spaced arrays of horns disposed about said housing to reduce both forward and backward sound propagation and to increase the area of acoustic radiation cancellation.

26. Apparatus for reducing noise emanating from a source into a predetermined environment, said apparatus comprising:

sensing means for sensing acoustic energy in said environment;

fluidic amplifier means responsive to acoustic energy sensed by said sensing means for providing a fluidically amplified sound signal; delivery means for delivering said amplified sound signal to a location in said environment where the amplified sound signal is in substantial phase opposition to said noise to thereby destructively interfere with and reduce said noise;

a light source for providing a light beam of known intensity;

modulation means responsive to said acoustic energy sensed by said sensing means for modulating the intensity of said light beam as a function of said sensed acoustic energy;

means for conducting the intensity-modulated light beam to said fluidic amplifier means; and means for converting said intensity-modulated light beam to a pressure signal for amplification by said fluidic amplifier means.

* * * * *